US007526823B2

(12) United States Patent
Koch

(10) Patent No.: US 7,526,823 B2
(45) **Date of Patent: *May 5, 2009**

(54) PATIENT BED SYSTEM

(75) Inventor: Guido Koch, Karlsruhe (DE)

(73) Assignee: Maquet GmbH & Co. KG, Rastatt (DE)

( * ) Notice: Subject to any disclaimer, the term of this patent is extended or adjusted under 35 U.S.C. 154(b) by 0 days.

This patent is subject to a terminal disclaimer.

(21) Appl. No.: 11/598,526

(22) Filed: Nov. 13, 2006

(65) Prior Publication Data

US 2007/0107123 A1 May 17, 2007

(30) Foreign Application Priority Data

Nov. 14, 2005 (DE) ..... 10 2005 054 220

(51) Int. Cl.
*A61G 7/08* (2006.01)

(52) U.S. Cl. ..... 5/600; 5/86.1

(58) Field of Classification Search ..... 5/600, 5/86.1, 81.1 R, 83.1, 611, 11; 403/326
See application file for complete search history.

(56) References Cited

U.S. PATENT DOCUMENTS

| | | | | |
|---|---|---|---|---|
| 2,416,410 | A | | 2/1947 | Shampaine |
| 2,763,320 | A | | 9/1956 | Schram |
| 2,764,459 | A | | 9/1956 | McDonald |
| 2,775,496 | A | | 12/1956 | Berggren |
| 2,995,762 | A | | 8/1961 | Albinson |
| 3,328,079 | A | | 6/1967 | Byczkowski et al. |
| 4,597,119 | A | | 7/1986 | Padgett |
| 5,031,547 | A | | 7/1991 | Hirose |
| 5,083,331 | A | | 1/1992 | Schnelle et al. ..... 5/60 |
| 5,220,698 | A | * | 6/1993 | Hannant ..... 5/611 |
| 5,477,570 | A | * | 12/1995 | Hannant et al. ..... 5/86.1 |
| 5,564,852 | A | | 10/1996 | Maxwell et al. |

(Continued)

FOREIGN PATENT DOCUMENTS

DE 264297 8/1912

(Continued)

OTHER PUBLICATIONS

European Search Report for Serial No. EP 06 12 3598 dated Feb. 8, 2007.

(Continued)

*Primary Examiner*—Robert G Santos
(74) *Attorney, Agent, or Firm*—McCormick, Paulding & Huber LLP

(57) ABSTRACT

In a patient bed system, comprising a patient bed, a support column for supporting the bed and a trolley for transporting the bed, the bed having arranged on it first coupling elements (22) which are intended for selective connection to second or third coupling elements (24, 26) on the support column and on the trolley respectively, at least one of the coupling elements (24) located on the support-column side has provided on it at least one sensor (102) for sensing the position of a first coupling element (22) connected to the bed (18) in relation to the column-side coupling element (24), the sensor (102) taking effect when the bed is located on the trolley and the latter assumes in relation to the support column a specific position for transferring the bed onto the latter.

1 Claim, 5 Drawing Sheets

U.S. PATENT DOCUMENTS

| | | | | |
|---|---|---|---|---|
| 5,611,638 | A * | 3/1997 | Dorr et al. | 403/327 |
| 5,621,932 | A * | 4/1997 | Strachan | 5/600 |
| 5,651,150 | A * | 7/1997 | Kanitzer et al. | 5/600 |
| 5,754,997 | A | 5/1998 | Lussi et al. | |
| 6,095,713 | A | 8/2000 | Doyle et al. | |
| 6,351,678 | B1 | 2/2002 | Borders | |
| 6,390,927 | B1 | 5/2002 | Cleveland, III | |
| 6,619,872 | B2 | 9/2003 | Crorey et al. | |
| 6,722,289 | B2 | 4/2004 | Kato | |
| 6,986,179 | B2 | 1/2006 | Varadharajulu | |
| 7,181,791 | B2 * | 2/2007 | Clayton | 5/600 |
| 7,367,740 | B2 | 5/2008 | Lazic et al. | |
| 7,398,790 | B2 | 7/2008 | Glatz | |
| 2002/0170115 | A1 | 11/2002 | Borders et al. | |
| 2003/0078144 | A1 | 4/2003 | Gehrke | |
| 2004/0006821 | A1 | 1/2004 | Hand et al. | |
| 2004/0172757 | A1 | 9/2004 | Somasundaram | |
| 2007/0101497 | A1 | 5/2007 | Revenus | |
| 2007/0101500 | A1 | 5/2007 | Fruh et al. | |
| 2007/0107123 | A1 * | 5/2007 | Koch | 5/509.1 |
| 2007/0107124 | A1 | 5/2007 | Koch | |
| 2007/0107125 | A1 | 5/2007 | Koch | |
| 2007/0107126 | A1 | 5/2007 | Koch | |
| 2007/0107129 | A1 | 5/2007 | Burstner | |
| 2007/0110448 | A1 | 5/2007 | Ruch | |
| 2007/0116512 | A1 | 5/2007 | Katzenstein | |
| 2007/0118989 | A1 | 5/2007 | Koch | |

FOREIGN PATENT DOCUMENTS

| | | | |
|---|---|---|---|
| DE | 4229318 | C1 | 9/1993 |
| DE | 296 10 726 | U1 | 9/1996 |
| DE | 197 32 467 | A1 | 2/1999 |
| DE | 197 51 320 | A1 | 5/1999 |
| DE | 199 19 496 | A1 | 11/2000 |
| DE | 102 53 878 | A1 | 5/2004 |
| DE | 102 53 906 | A1 | 6/2004 |
| EP | 0 457 246 | A1 | 5/1991 |
| EP | 0 457 246 | A1 | 11/1991 |
| EP | 0 625 348 | A1 | 11/1994 |
| EP | 0832603 | A1 | 4/1998 |
| EP | 0 913 139 | A1 | 5/1999 |
| FR | 2388546 | | 11/1978 |
| GB | 1 321 193 | | 6/1973 |
| GB | 2260075 | A | 4/1993 |
| GB | 2 277 870 | A | 11/1994 |
| WO | 99 28146 | | 6/1999 |
| WO | 02 055001 | A1 | 7/2002 |
| WO | 03 086263 | A1 | 10/2003 |

OTHER PUBLICATIONS

European Search Report for EP 06 12 3443 dated Feb. 7, 2007.
European Search Report for EP 06 12 3596 dated Sep. 7, 2007.
European Search Report for EP 06 12 3719 dated Sep. 7, 2007.
European Search Report for EP 06 12 3593 dated Dec. 4, 2007.
European Search Report for EP 06 12 3592 dated Nov. 29, 2007.
European Search Report for Application No. EP 06 12 3721, dated Jun. 20, 2008.
European Search Report for Application No. EP 06 12 3444, dated Aug. 22, 2008.

* cited by examiner

PATIENT BED SYSTEM

CROSS REFERENCE TO RELATED APPLICATIONS

Applicant hereby claims foreign priority benefits under U.S.C. § 119 from German Patent Application No. 10 2005 054 220.4 filed on Nov. 14, 2005, the contents of which are incorporated by reference herein.

FIELD OF THE INVENTION

The invention relates to a patient bed system, comprising a patient bed, a support column for supporting the bed and a trolley for transporting the bed, the bed having arranged on it first coupling elements which are intended for selective connection to second or third coupling elements on the column and on the trolley respectively.

BACKGROUND OF THE INVENTION

Such a system is known, for example, from EP 457 246 B1. To transfer the bed onto the trolley, the latter is brought into a suitable position in relation to the support column. By means of the downward movement of the height adjustment device of the support column, the bed is first lowered, until it lies on the trolley. At the moment of transfer the first coupling elements on the bed are simultaneously in engagement with the second and third coupling elements on the column and on the trolley respectively.

SUMMARY OF THE INVENTION

In order to ensure a satisfactory and as far as possible constraint-free transfer of the bed from the trolley onto the column, and vice versa, the coupling elements should be aligned exactly with one another before transfer, so that they can slide one into the other, as far as possible free of constraint. This presupposes that the column head, which, of course, as a rule, can be adjusted to vary the position of the patient on an operating table, is in an exactly defined position in relation to the floor of the operating theatre on which the trolley stands. Also, for any reason, the position of the patient bed on the trolley may not be exactly parallel to the floor of the operating theatre. Since these deviations sometimes cannot be detected or cannot so quickly be detected by the naked eye, it is proposed, according to the invention, that at least one of the coupling elements located on the support-column side has provided on it at least one sensor for sensing the position of a first coupling element connected to the bed in relation to the column-side coupling element, the sensor taking effect when the bed is located on the trolley and the latter assumes in relation to the support column a specific position for transferring the bed onto the latter. Expediently, the sensor is connected to a control controlling the actuating drive of the column head. When the sensor detects a deviation from the desired alignment of the bed-side coupling elements in relation to the column-side coupling elements or the coupling elements on the trolley, then the control, in response to a corresponding signal from the sensor, causes an adjustment of the column head until the coupling elements are exactly in alignment with one another. The sensor may be formed, for example, by a deflectable finger which senses one of the contours of the bed-side or trolley-side coupling elements.

BRIEF DESCRIPTION OF THE DRAWINGS

The following description explains the invention by means of exemplary embodiments, in conjunction with the accompanying drawings in which.

DETAILED DESCRIPTION OF THE INVENTION

Figure 1:
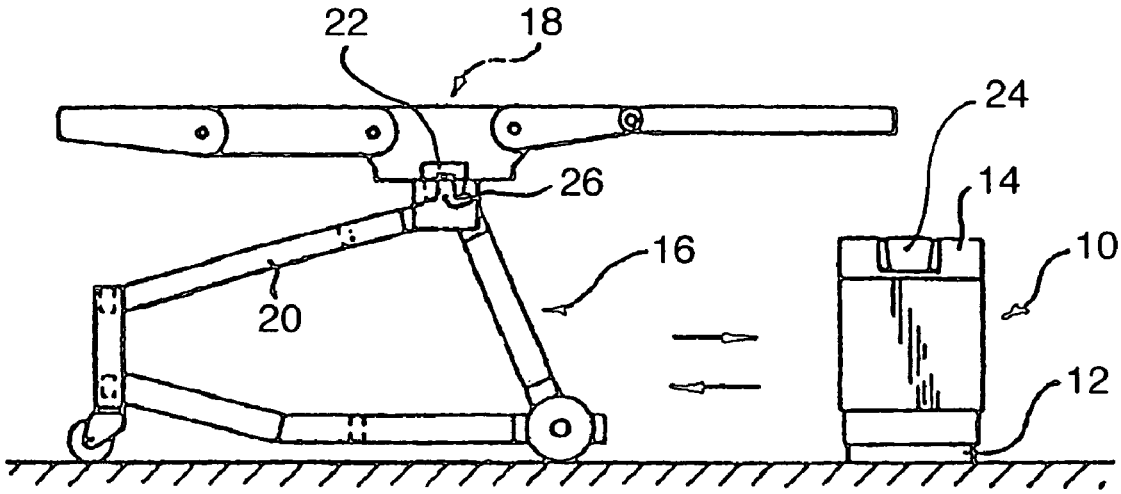
FIG. 1 shows a diagrammatic illustration of a patient bed system comprising a patient bed, a trolley for a bed and a support column for a patient bed.

The patient bed system, illustrated diagrammatically in FIG. 1, comprises a support column, designated in general by 10, of an operating table, with a column foot 12 and with a column head 14 mounted vertically adjustably on the latter. The height adjustment device is not illustrated. It may be designed in any conventional way. As a rule, this may be a hydraulic or mechanical lifting device.

Located on the left, next to the support column, is a trolley, designated in general by 16, which carries a bed or table board 18 of the operating table. The trolley 16 comprises two side frame parts 20 which are connected to one another by means of crosspieces, not illustrated, as is illustrated in EP 457 246 B1. The trolley 16 can be moved up to the support column 10 such that the latter lies between the side frame parts 20.

On the longitudinal side edges of the bed 18, first coupling elements 22 are arranged, which are intended for engagement into second coupling elements 24 on the column head 14 or third coupling elements 26 on the side frame parts 20 of the trolley 16, in order to connect the bed 18 either to the support column 10 or to the trolley 16. The more detailed configuration of the coupling elements and their mode of operation will now be described in more detail below.

Figure 2:
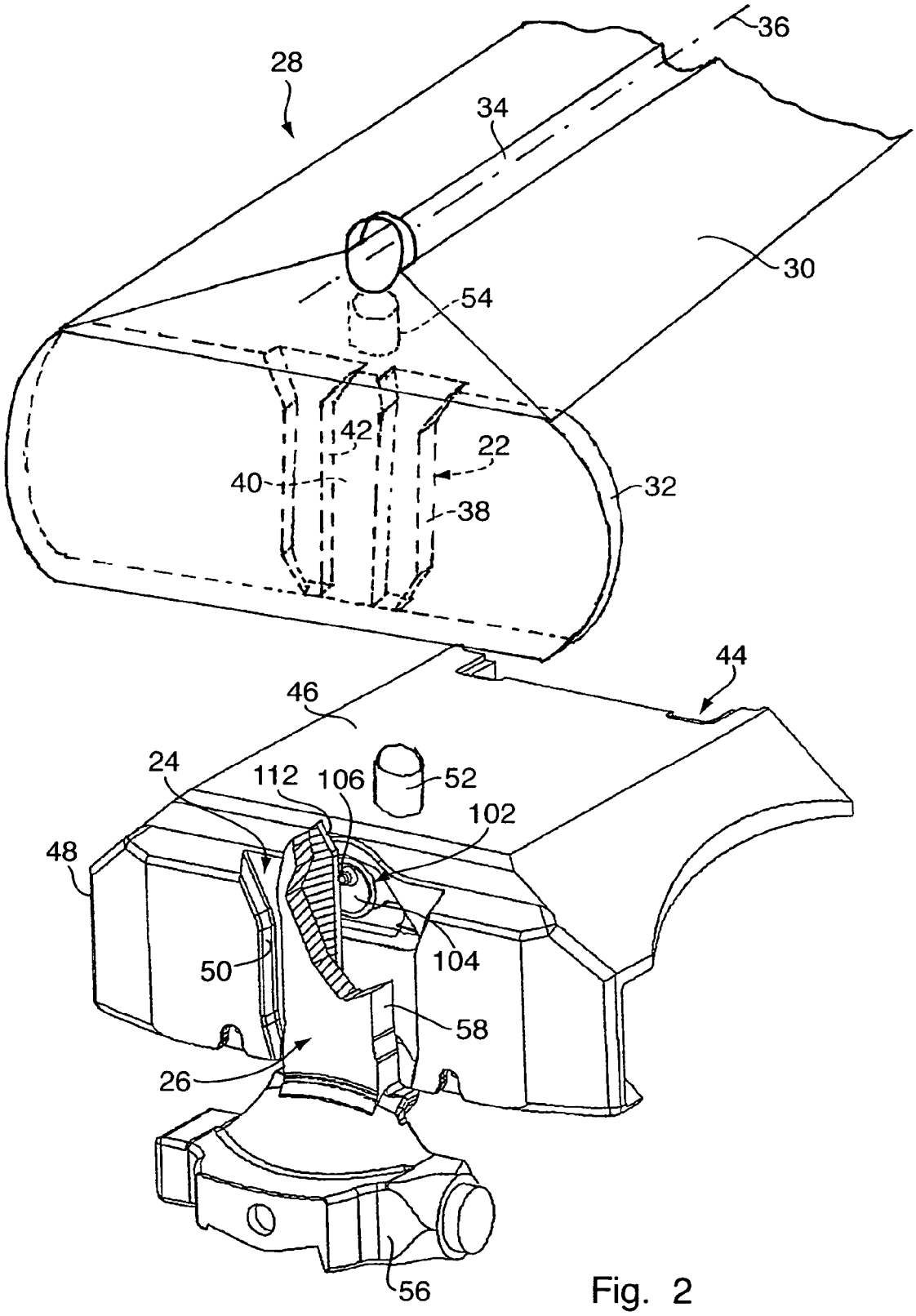
FIG. 2 shows a partially diagrammatic illustration of the three coupling elements cooperating with one another.

In FIG. 2, 28 designates a connecting frame which comprises a middle plate 30 and two side cheeks 32 which project downward at its longitudinal ends and only one of which is illustrated. The middle plate 30 has on its top side bedding 34 for connection to the actual patient bed 18 which is mounted on the connecting frame 28 pivotably about the bedding axis 36 running transversely with respect to the longitudinal direction of the said patient bed. Each of the cheeks 32 carries on its inside a first coupling element 22. The latter has the configuration of a broad tenon with an outer contour 38, and also a slot-shaped clearance 40 with an inner contour 42.

Below the connecting frame 28 is located a saddle 44, illustrated, only partially, which is part of the column head 14. It is of C-shaped construction, in a similar way to the connecting frame 28, with a middle web 46 and with two side parts 48, only one of which is illustrated. The side part 48 has on its outside a reception pocket, forming the second coupling element 24, for receiving the first coupling element 22, the reception pocket having an inner contour 50 adapted to the outer contour 38 of the first coupling element 22. The middle web 46, near its respective side part 48, carries on its top side a centring pin 52 which is intended for engagement into a complementary pin receptacle 54 formed on the underside of the middle plate 30 of the connecting frame 28.

In the illustration of FIG. 2, there projects into the reception pocket of the second coupling element 24 a guide tenon which forms the third coupling element 26 and which is fastened to the trolley 16 via a pedestal 56 and is intended for engagement into the clearance 40 of the respective first coupling element 22. The said guide tenon has an outer contour 58 corresponding to the inner contour 42 of the first coupling element 22.

Figure 3:
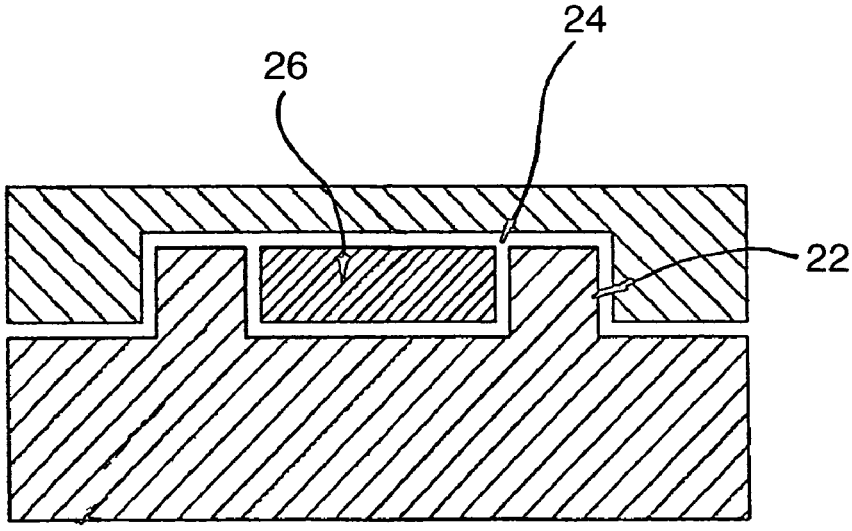
FIG. 3 shows a diagrammatic section through the three coupling elements simultaneously in engagement with one another.

If all three coupling elements 22, 24, 26 are simultaneously in engagement with one another during the transfer of the bed from the trolley onto the support column, and vice versa, they are nested one in the other, as may be seen in the diagrammatic illustration of FIG. 3. The tenon forming the third coupling element 26 lies in the clearance 40 of the first coupling element 22 which, in turn, engages into the reception pocket forming the second coupling element 24, so that all three coupling elements lie as it were in one plane. This results in a type of construction which is very flat transversely with respect to the longitudinal direction of the bed 18.

The further benefits of this arrangement may be gathered from the following description of the locking mechanism, by means of which the bed 18 is connected alternately either to the column head 14 or to the trolley 16.

Figure 4:
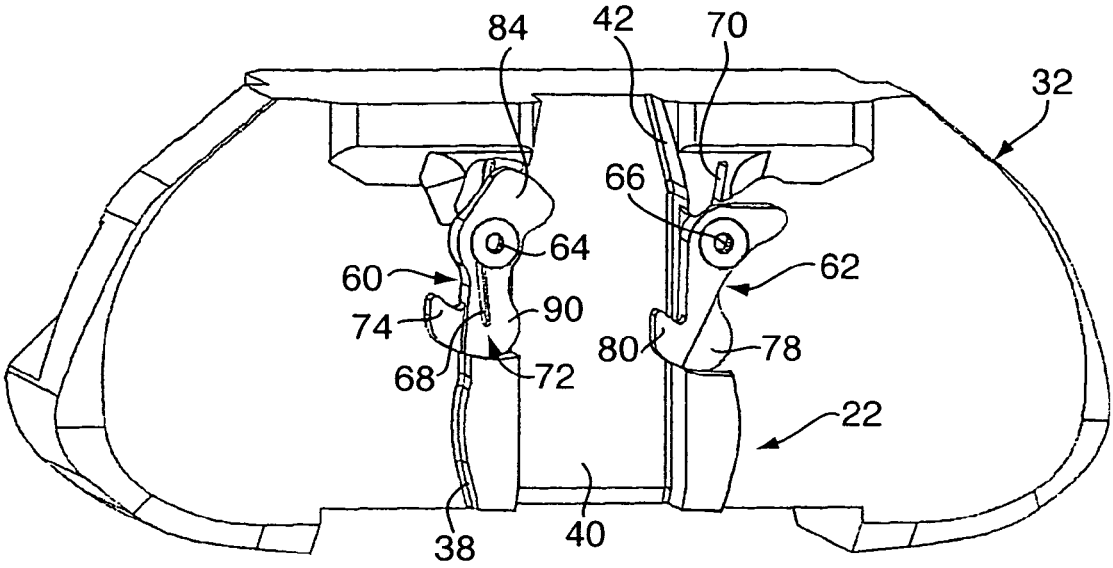
FIG. 4 shows a partially diagrammatic illustration of a first coupling element alone, which is arranged on a bed-side part.
Figure 5:
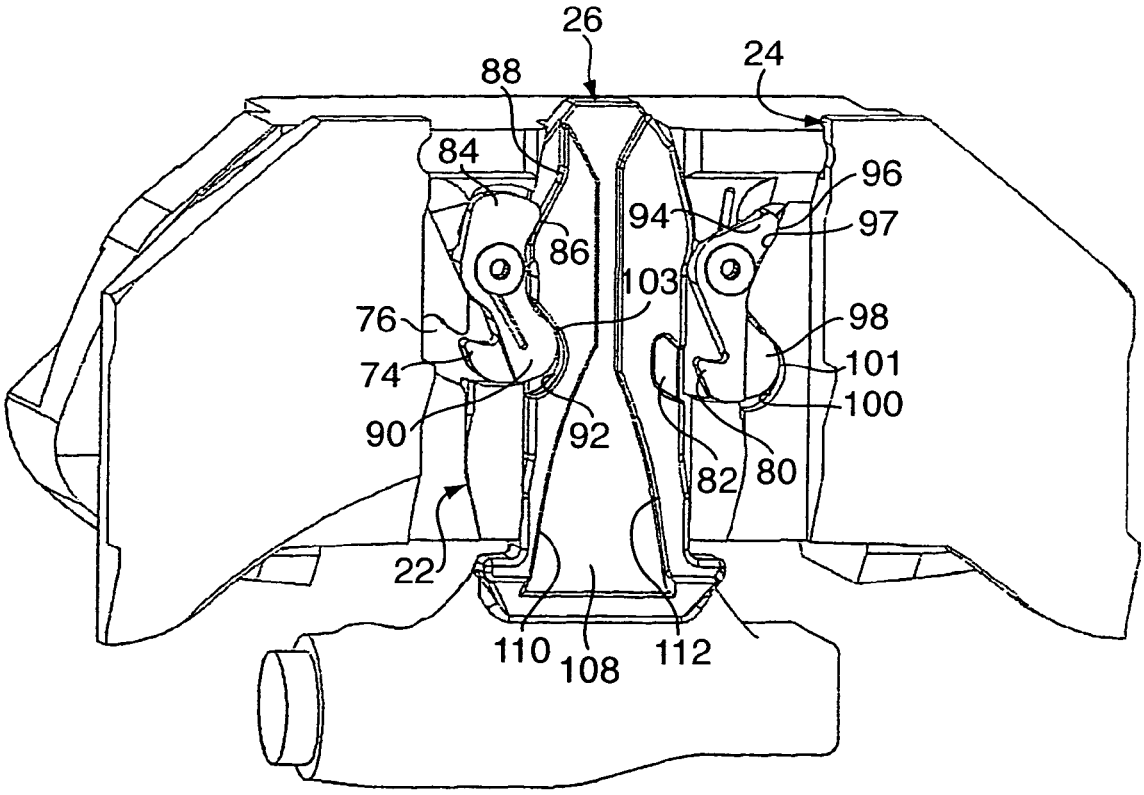
FIG. 5 shows a diagrammatic illustration of the three coupling elements simultaneously in engagement with one another.

FIG. 4 shows a diagrammatic top view of the inside of a cheek 32 of the connecting frame 28. The first coupling element 22, on which two locking elements 60 and 62 are mounted adjustably, can be seen once again. The locking elements 60 and 62 are designed in each case in the form of a two-armed lever which is mounted pivotably about a pivot axis 64 or 66 and which is prestressed in each case clockwise by means of a torsion spring 68 or 70. The locking element 60 is intended for locking the bed 18 to the column head 14. For this purpose, one lever arm 72 is provided with a hooked extension 74 which is intended for engagement into a clearance 76 on the inner contour 50 of the second coupling element 24 (FIG. 5). The locking element 62 is intended for locking the bed 18 to the trolley 16. For this purpose, the lever arm 78 of the locking element 62 has a hooked extension 80 which is intended for engagement into a clearance 82 on the outer contour 58 of the tenon-shaped third coupling element 26 (FIG. 5).

The mode of operation of the locking elements during the transfer of the bed 18 from the column 10 onto the trolley 16 will now be described with reference to FIG. 5 to 7.

FIG. 5 shows the three coupling elements 22, 24 and 26 in complete engagement with one another. In this state, both locking elements 60 and 62 are pivoted into their release position. In the case of the locking element 60, this takes place in that the lever arm 84 opposite to the lever arm 72 slides with control edge 86 on a control cam 88 formed on the third coupling element 26 and is at the same time pivoted anti-clockwise, that end 90 of the first lever arm 72 which is opposite to the hooked extension 74 of the first locking element 60 penetrating into a semicircular clearance 92 in the outer contour of the third coupling element, as shown in FIG. 5. In the same way, the second locking element 62 is pivoted anti-clockwise, in that a lever arm 94 opposite to the lever arm 78 slides with a control edge 96 on a control cam 97 formed on the second coupling element 24, once again that end 98 of the first lever arm 78 which is opposite to the hooked extension 80 penetrating into a semicircular clearance 100 in the second coupling element 24, as shown in FIG. 5.

Figure 6:
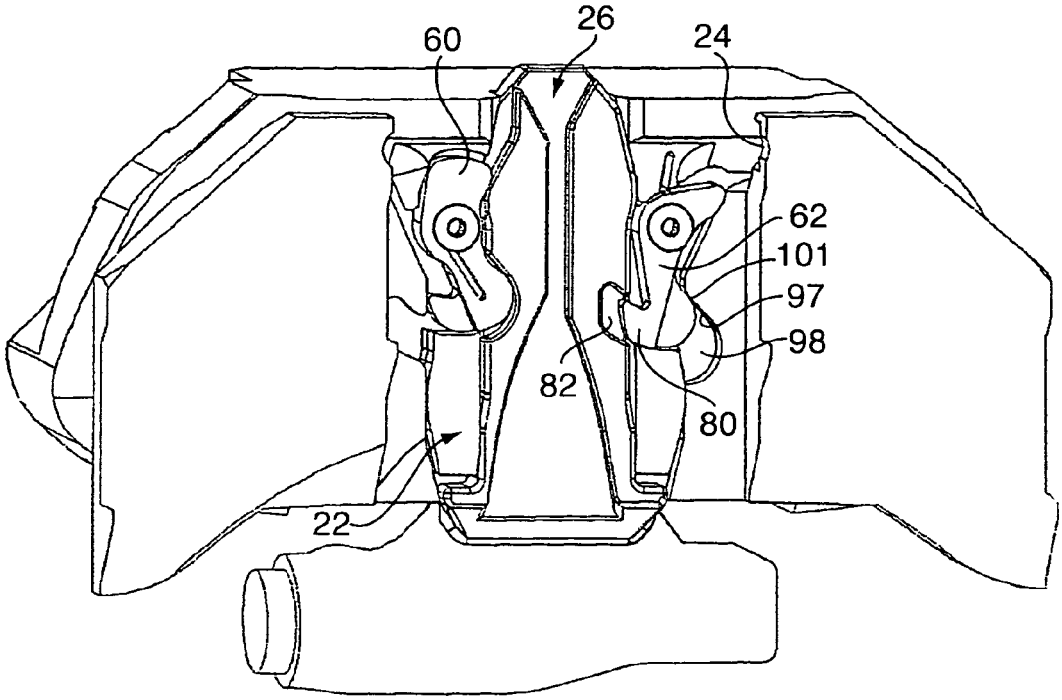
FIGS. 6 and 7 show in each case an illustration of the three coupling elements during the transfer of the bed from the support column onto the trolley.
Figure 7:
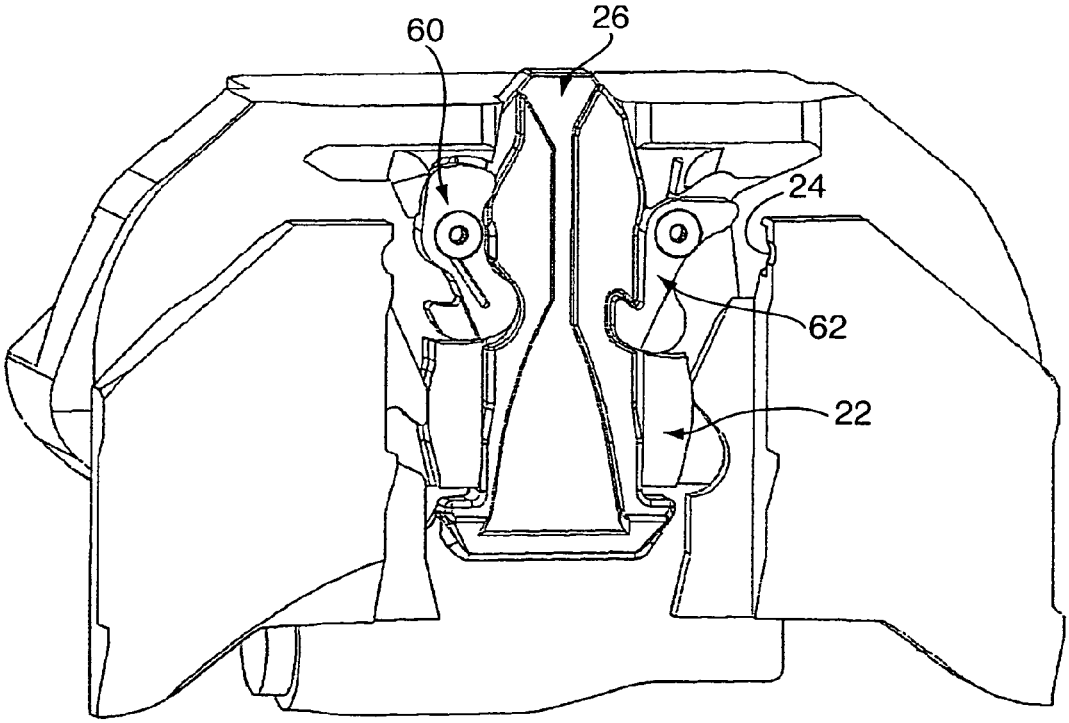

During the transfer of the bed 18 onto the trolley 16, the column head 14 of the support column 10 is lowered out of the position illustrated in FIG. 5, as can be seen in FIGS. 6 and 7. FIG. 6 shows that, with the commencement of the downward movement of the column head 14 and consequently of the second coupling element 24, the right-hand locking element 62 is pivoted clockwise under the action of the control cam 97, sliding on a control edge 101 of the lever end 98, of the second coupling element 24, so that the hooked extension 80 is moved into the clearance 82. Even in the position illustrated in FIG. 6, the bed 18 could no longer be lifted off from the trolley 16. When the column head 14 is lowered further, as shown in FIG. 7, the hooked extension 80 of the second locking element 62 is pivoted completely into the clearance 82 in the third coupling element 26, so that the bed 18 is locked firmly to the trolley 16. In this position, the hooked extension 80 is held as a result of the action of the torsion spring 70. Conversely, during the raising of the column head 14 out of the position illustrated in FIG. 7, the locking element 62 would be pivoted anti-clockwise, so that the lock between the first and the third coupling element is cancelled.

Figure 8:
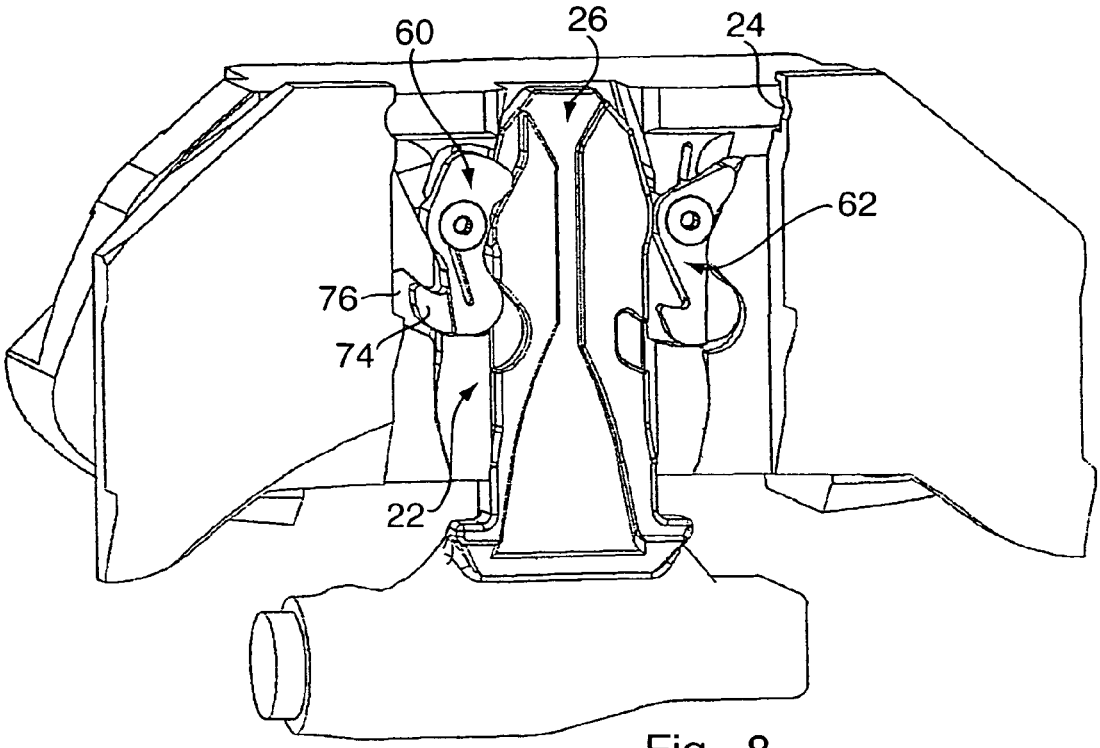
FIGS. 8 and 9 show in each case illustrations, corresponding to FIGS. 6 and 7, during the transfer of the bed from the trolley onto the support column.
Figure 9:
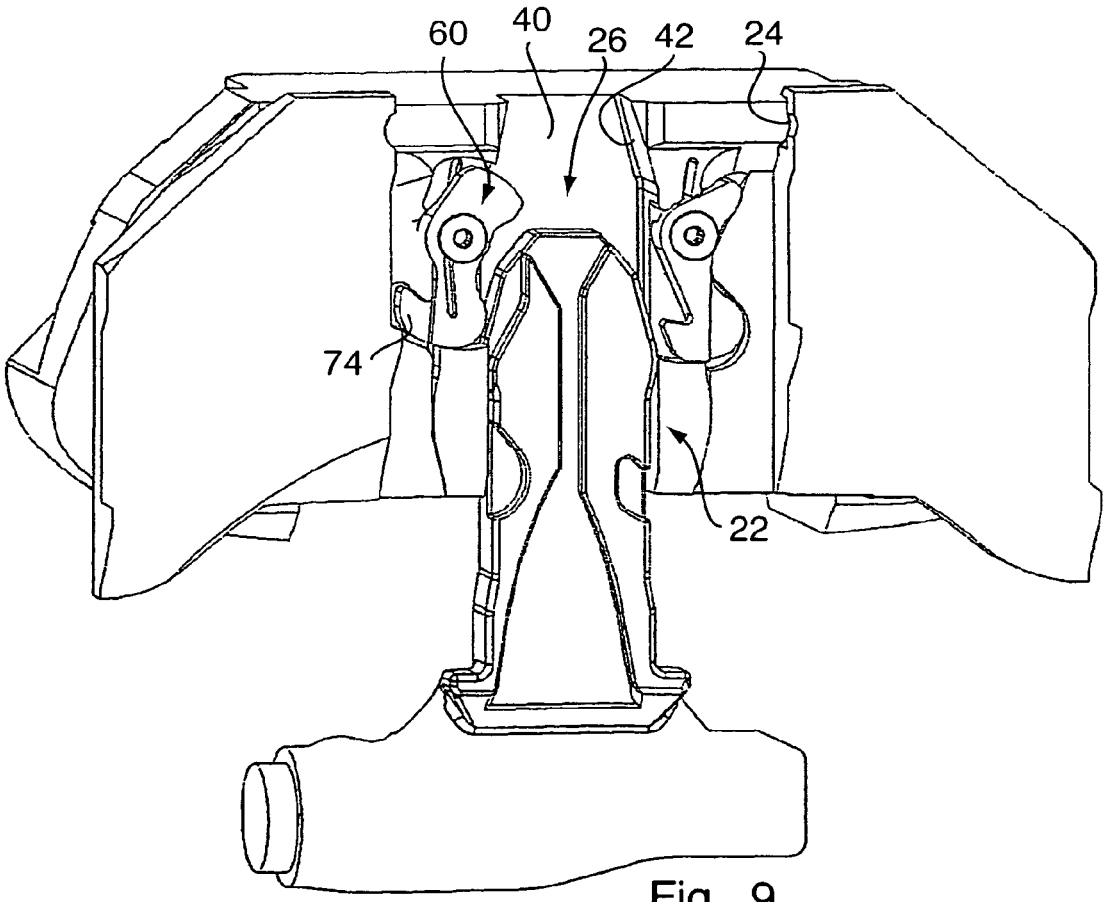

FIGS. 8 and 9 show the locking operation during the transfer of the bed 18 from the trolley 16 onto the support column 10. In this case, starting from the position illustrated in FIG. 5, the column head 14 is raised, so that the third coupling element 26 slides downward out of the clearance 40 of the first coupling element 22. At the same time, in this case, the first locking element 60 is positively pivoted clockwise by the control cam 88 sliding on a control edge 103 on the lever end 90 and located on the third coupling element 26, so that the hooked extension 74 of the first locking element 60 engages into the clearance 76 in the column-side second coupling element 24, as shown in FIG. 8. When the third coupling element is drawn out of the first coupling element, the bed 18 is locked firmly to the column head 14, as shown in FIG. 9. Conversely, when the third coupling element 26 is introduced into the clearance 40 of the first coupling element 22, the locking element 60 is pivoted anti-clockwise, so that the lock between the second and the first coupling element is released. The above description shows that the two locking elements 60 and 62 are in each case pivoted positively during the coupling operations, so that a reliable lock between the bed and the column head, on the one hand, and the bed and the trolley, on the other hand, is ensured.

It can be seen, furthermore, that, starting from the position according to FIG. 5, in which both locking elements 60 and 62 are pivoted into their release position, if the bed 18 were raised with respect to the column head and the trolley, both locking elements would be pivoted clockwise and consequently be locked. The bed 18 is thus reliably prevented from being lifted out of the position illustrated in FIG. 5.

In order to achieve an as far as possible friction-free transfer of the bed from the column onto the trolley, or vice versa, the coupling elements 22, 24 and 26 should lie exactly in alignment with one another. If they are tilted with respect to one another, malfunctions may occur. In order to avoid this, the saddle 44 has arranged on it, within the reception pocket of the second coupling element 24, a sensor, designated in general by 102, which is intended to sense the position of the third coupling element 26 in relation to the second coupling element 24. The sensor comprises a rotatably mounted disc 104 which is connected, for example, to a potentiometer tap and on the outside of which is provided an eccentrically arranged sensing finger 106. This sensing finger 106 engages into a clearance 108 which is formed on a wide side of the third coupling element 26 and which is delimited by two control edges 110 and 112. If the transport trolley 16 and the column head 14 are inclined with respect to one another during the take-over operation, so that the coupling elements 24 and 26 are not aligned with one another in the desired form, the sensing finger 106 butts against one of the control edges 110, 112. The disc 104 is thereby rotated. This rotation is detected, for example, via the connected potentiometer and can be converted into a control signal which is supplied, in turn, to the control of the column head 14. The column head 14 can thereby be adjusted such that the second and the third coupling element are aligned with one another, in order to allow friction-free coupling.

The conversion of the deflection of the sensing finger 106 into a control signal can, of course, also be effected in another suitable way. Likewise, the sensor can be arranged in such a way that it senses a contour of the first, bed-side coupling element 22, since the alignment of the first coupling elements with respect to the column-side second coupling elements 24 is of primary importance.

While the present invention has been illustrated and described with respect to a particular embodiment thereof, it should be appreciated by those of ordinary skill in the art that various modifications to this invention may be made without departing from the spirit and scope of the present invention.

What is claimed is:

1. A patient bed system comprising a patient bed, a support column for supporting the bed and a trolley for transporting the bed, the bed having arranged on it first coupling elements which are intended for selective connection to second or third coupling elements on the support column and on the trolley respectively, wherein at least one of the coupling elements located on the support-column side has provided on it at least one sensor for sensing the position of a first coupling element connected to the bed in relation to the column-side coupling element, the sensor formed by a deflectable finger for sensing one of the contours of the bed-side or trolley-side coupling elements, the sensor taking effect when the bed is located on the trolley and the trolley assumes in relation to the support column a specific position for transferring the bed onto the support column.

* * * * *